US008109121B2

(12) United States Patent
Shin et al.

(10) Patent No.: US 8,109,121 B2
(45) Date of Patent: Feb. 7, 2012

(54) DRUM TYPE WASHING MACHINE WITH GASKET DRAIN

(75) Inventors: Su-Hee Shin, Changwon (KR); Min-Su Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 647 days.

(21) Appl. No.: 12/232,108

(22) Filed: Sep. 10, 2008

(65) Prior Publication Data

US 2009/0126418 A1 May 21, 2009

(30) Foreign Application Priority Data

Sep. 13, 2007 (KR) ..... 10-2007-0093297
Sep. 13, 2007 (KR) ..... 10-2007-0093298

(51) Int. Cl.
*D06F 39/08* (2006.01)
*D06F 39/14* (2006.01)

(52) U.S. Cl. ..... 68/196; 68/208

(58) Field of Classification Search ..... 68/23 R, 68/24, 139, 140, 196, 208
See application file for complete search history.

(56) References Cited

U.S. PATENT DOCUMENTS 2,968,174 A * 1/1961 Bell et al. ..... 68/23.6
3,159,174 A * 12/1964 Mann et al. ..... 137/374
4,104,542 A * 8/1978 Karklys et al. ..... 307/141
7,251,963 B2 * 8/2007 Kim et al. ..... 68/196
7,571,626 B2 * 8/2009 Choi et al. ..... 68/196
7,845,200 B2 * 12/2010 Cimetta et al. ..... 68/208
7,958,756 B2 * 6/2011 Gracia Bobed ..... 68/24
2004/0148978 A1 8/2004 Kim
2004/0244438 A1 12/2004 North
2005/0178170 A1 * 8/2005 Kim et al. ..... 68/24
2006/0260065 A1 * 11/2006 Wright et al. ..... 8/158

FOREIGN PATENT DOCUMENTS

| | | |
|---|---|---|
| DE | 10065344 | 7/2002 |
| EP | 0752493 | 1/1997 |
| EP | 1219742 | 7/2002 |
| FR | 2093614 | 1/1972 |
| GB | 2181222 | 4/1987 |

* cited by examiner

*Primary Examiner* — Joseph L Perrin
(74) *Attorney, Agent, or Firm* — McKenna Long & Aldridge LLP

(57) ABSTRACT

Disclosed is a drum type washing machine comprising a cabinet having an opening, a door installed at the cabinet, a tub installed in the cabinet, a drum rotatably installed in the tub, a gasket sealing a gap between the door and the tub by being installed between the opening of the cabinet and the tub and a moisture removing means provided at the gasket and a means sealing a gap between the door and the tub installed between the opening of the cabinet and the tub to prevent pollutants from being generated at a middle of a lower end of an inner side surface or to prevent washing water from remaining thereat, where the residual washing water preventing means is implemented as a drain portion or a heating member provided at the gasket that is capable of preventing odor or foreign substances caused by moisture remaining at the gasket.

5 Claims, 6 Drawing Sheets

DRUM TYPE WASHING MACHINE WITH GASKET DRAIN

This application claims the benefit of Korean Patent Application Nos. 10-2007-0093297 and 10-2007-0093298, both of which were filed in Korea on Sep. 13, 2007, which are hereby incorporated by reference for all purposes in their entirety as if fully set forth herein.

BACKGROUND OF THE INVENTION

1. Field of the Invention

The present invention relates to a drum type washing machine, more particularly, to a drum type washing machine having a means for removing washing water or foreign materials remaining at a gasket of the drum type washing machine.

2. Description of the Related Art

In general, a washing machine serves to wash laundry through washing, rinsing and dehydrating processes using water in which detergent is dissolved or clean water so as to remove pollutants remaining at laundry such as clothes, bedclothes.

The washing machine in the related art includes a cabinet having an opening through which laundry is introduced into, a door by which the opening is opened/closed, a tub installed to be attenuatable in the cabinet so as to contain washing water, a water supply device including a water supply valve so as to supply washing water to the tub, a drain device including a drain pump so as to drain polluted washing water in the tub, a drum rotatably installed in the tub so as to contain laundry, a motor installed at the tub so as to rotate the drum and a door switch by which the door is locked/unlocked. And, a gasket is installed at a periphery of the opening so as to seal a gap between the opening and the tub.

However, since the drum type washing machine in the related art is not provided with an additional device or configuration for removing washing water still remaining at the gasket after completing a washing or dehydrating process for the laundry, the washing water remaining at the gasket comes to be polluted as time elapses, and accordingly foreign materials such as mold or odor may be generated, which causes a user to be unpleasant and unsanitary.

Also, the laundry is stained with the foreign materials such as mold caused by washing water remaining at the gasket or be permeated with odor, accordingly a washing performance of the washing machine may be deteriorated.

SUMMARY OF THE INVENTION

Therefore, the present invention is directed to providing a drum type washing machine which is capable of naturally draining moisture remaining at a gasket by forming a drain portion and a drain hole at the gasket installed between a door and an opening.

And, another object of the present invention is to provide a drum type washing machine which is capable of forcibly draining moisture remaining at a gasket by additionally forming a compulsory drain means at an outer side of a lower portion of a drain portion or a drain hole of the gasket.

And, still another object of the present invention is to provide a drum type washing machine which is capable of effectively inducing moisture remaining at a gasket to be introduced into a drain portion formed at a lower portion of the gasket by forming a blower and a blower guide portion at an upper portion of the gasket.

And, yet still another object of the present invention is to provide a drum type washing machine which is capable of evaporating moisture remaining at a gasket by heating the gasket by installing a heating member at the gasket.

To achieve the aforementioned objects, in accordance with one aspect of the present invention, there is provided a drum type washing machine comprising: a cabinet having an opening through which laundry is introduced into, a door installed at the cabinet, by which the opening is opened/closed, a tub installed in the cabinet, a drum rotatably installed in the tub and a gasket installed between the opening of the cabinet and the tub so as to seal a gap between the door and the tub, wherein a drain portion is formed at a middle portion of a lower end of the gasket so as to prevent moisture from remaining thereat.

Here, the drain portion is concavely formed at a lower end portion of the gasket. By concavely forming the drain portion, it is capable of enhancing a collection efficiency on washing water. In addition, if the drain portion is inclinedly formed, the collection efficiency may be more enhanced.

And, the drain portion may be further provided with a drain hole. In case that only the drain portion is formed, the washing water collected in the drain portion can be removed only in an air dry or evaporative manner. Meanwhile, in case of additionally forming the drain hole at the drain portion, since washing water collected in the drain portion can be smoothly drained through the drain hole, it is capable of enhancing a removal efficiency on the washing water.

Meanwhile, in accordance with another aspect of the present invention, there is provided a drum type washing machine including a compulsory drain means for removing moisture collected in the drain portion at the gasket. As such, by additionally installing the compulsory drain means together with the drain portion, it is capable of more enhancing a drainage efficiency on washing water.

Here, the compulsory drain means is implemented as a drain pump installed at a lower portion of the cabinet so as to outwardly drain washing water. The drain pump is connected to the drain hole formed at the drain portion, preferably. That is, the washing water collected in the drain portion can be drained by using the pre-installed drain pump without installation of the additional compulsory drain means.

And, connection pipes communicated with the compulsory drain means may be mounted at the drain hole, thereby being capable of smoothly guiding washing water collected in the drain portion toward the compulsory drain means. The drain portion is concavely formed so that the washing water can be naturally drained through the drain hole.

Here, the compulsory drain means may be implemented as a separate suction fan installed between the drain pump installed at the lower portion of the cabinet so as to outwardly drain washing water and the drain portion, so as to suck residual water collected in the drain portion. It is effective that the suction fan is implemented as a fan motor in which a fan and a motor are integrally formed and is waterproofed.

By additionally installing the suction fan as the compulsory drain means in addition to the drain pump, it is capable of draining washing water that is not naturally drained.

Also, preferably, the suction fan is implemented as an axial fan so as to be advantageous to form a flow path through which washing water flows. That is, the flow path has only to be formed in back and forth directions of the axial fan, accordingly it is capable of simplifying a structure of the flow path.

Meanwhile, a blower by which air blows so as to collect residual water existing on a surface of the gasket to the drain portion may be further provided at one side of the upper portion of the gasket. Accordingly, the washing water not having flown toward the drain portion formed at the lower portion of the gasket can be introduced to the drain portion.

Here, it is more effective that at least one blower guide portion is formed at the gasket connected to an outlet end of the blower so that air blown by the blower can blow along the surface of the gasket. If there is no the blower guide portion, the air from the blower may be introduced into the drum without blowing along the surface of the gasket.

And, preferably, the blower is operated in a state that the door is closed. If the blower is operated in a state that the door is open, washing water remaining at the gasket may be naturally dried while air blows in and out.

Meanwhile, the blower is disposed to be face the drain portion so that air may uniformly blows on the entire surface of the gasket.

And, a check valve may be installed at the connection pipes or may be formed between the compulsory drain means and the drain pump. When operating the drain pump so as to drain the polluted washing water from the tub after completing a normal washing course, washing water collected in the drain portion of the gasket should not be introduced into the drain pump. By installing the check valve, it is capable of preventing the washing water collected in the drain portion from being introduced into the drain pump when draining washing water from the tub after completing the washing course.

Meanwhile, the drain portion may be coated with an antibiotic material such as lactic-acid of fermented kimchi, accordingly it is capable of preventing the gasket from being polluted by foreign materials such as mold.

Further, in accordance with still another aspect of the present invention, there is provided a drum type washing machine including a heating member for removing moisture existing at the gasket.

Accordingly, it is capable of preventing washing water or moisture from existing at a middle portion of a lower end of an inner side surface of the gasket. That's because the washing water or moisture is evaporated by the heating member heating the middle portion of the lower end of the inner side surface of the gasket. Here, the heating member is mounted in the gasket. Accordingly, it is capable of increasing the amount of heat conducted to the surface of the gasket from the heating member.

And, the heating member may be installed at the lower portion of the gasket with being spaced from the lower end portion of an inner side surface of the gasket or be attached onto an outer side surface of the lower end portion of the gasket.

In case that it is difficult to mount the heating member in the gasket since the gasket is thin, the heating member may be installed at the lower portion of the gasket with being spaced from the lower end portion of the gasket or be attached onto the outer side surface of the lower end portion of the gasket. Here, the heating member may be installed on an inner side surface of the lower end portion of the gasket. In this case, it is effective that the heating member is waterproofed.

The heating member is implemented as a heater or heat lines. Here, in case that the heating member is attached onto the inner side surface or the outer side surface of the lower end portion of the gasket, it is effective that the heating member is implemented as adhesive sticker type heat lines.

Also, the heater or the heat lines are formed in a strip type that is curved several times so as to maximize a heating value thereof, preferably.

Here, the heating member is configured to heat a portion corresponding to ⅓ to ½ of the entire length of the gasket. Since moisture is mainly collected at a periphery of the gasket including a lowermost end portion thereof, the heating member has only to be installed at the corresponding portion.

Meanwhile, the heating member is operated in a state that the door is closed. Air may be introduced into the drum when the door is open, thus washing water or moisture existing at the gasket may be naturally evaporated. In this case, it is not required to operate the heating member.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate preferred embodiments of the invention and together with the description serve to explain the principles of the invention.

In the drawings.

DETAILED DESCRIPTION OF THE INVENTION

Description will now be given in detail of the preferred embodiments of the present invention, examples of which are illustrated in the accompanying drawings.

Figure 1:
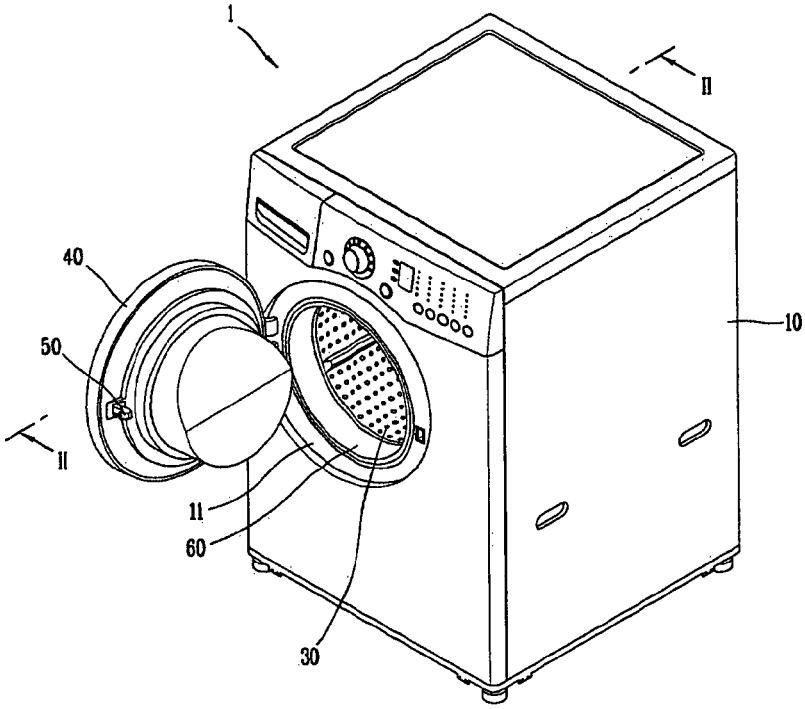
FIG. 1 is a perspective view showing a drum type washing machine in accordance with one exemplary embodiment of the present invention.
Figure 2:
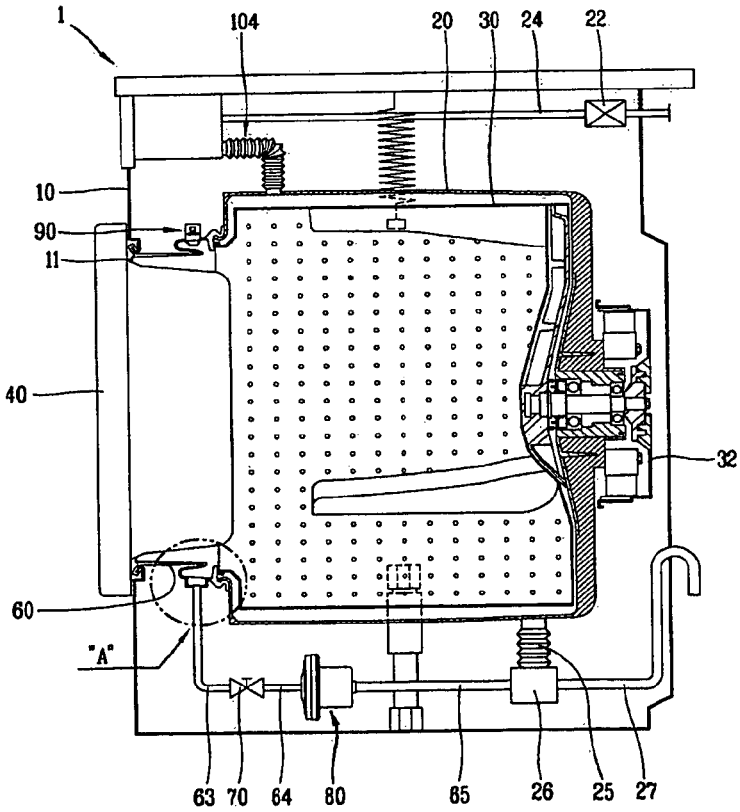
FIG. 2 is a section view taken along line II-II in FIG. 1.

FIG. 1 is a perspective view showing a drum type washing machine in accordance with one exemplary embodiment of the present invention, and FIG. 2 is a section view taken along line II-II in FIG. 1.

Referring to FIGS. 1 and 2, the drum type washing machine 1 in accordance with the one embodiment of the present invention includes a cabinet 10 having an opening 11 through which laundry is introduced into, a door 40 by which the opening 11 is opened/closed, a tub 20 installed to be attenuatable in the cabinet 10 so as to contain washing water, a water supply device 24 including a water supply valve 22 so as to supply washing water to the tub 20, a drain device including a drain pump 26 for draining polluted washing water in the tub 20 and a drain hose 27 for draining the polluted washing water to an outside of the washing machine 1, a drum 30 rotatably installed in the tub 20 so as to contain laundry, a motor 32 installed at the tub 20 so as to rotate the drum 30 and a door switch 50 by which the door 40 is locked/unlocked.

And, a gasket 60 is installed along a peripheral portion of the opening 11 so as to seal a gap between the opening 11 and the tub 20.

Figure 3:
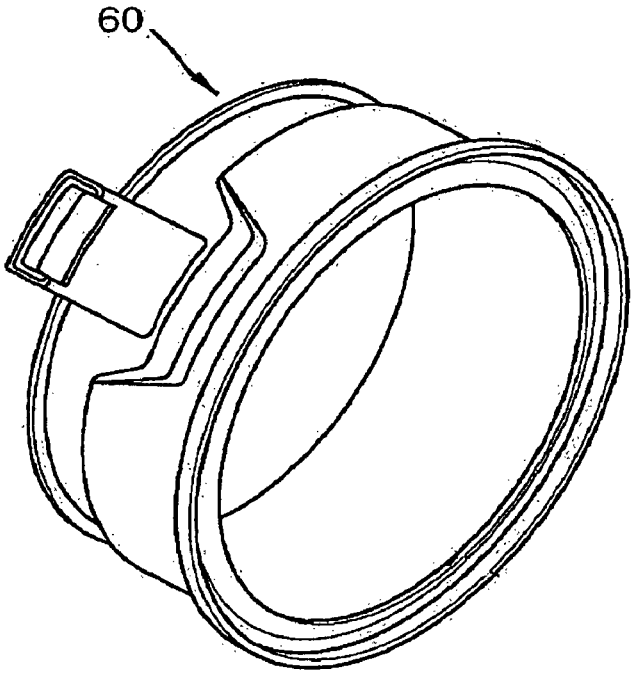
FIG. 3 is a perspective view showing a gasket of FIG. 2.

In FIG. 3, the gasket 60 is illustrated in a ring or loop shape having a specific height. And, the gasket 60 has a folded middle portion to overlap each other. Hereafter, it will be explained in detail with reference to FIG. 4 that is an enlarged section view showing "A" portion in FIG. 2.

Here, a drain portion 60*a* is formed at a middle of a lower end of an inner side surface of the gasket 60 so as to prevent washing water from remaining at the gasket 60. In the meantime, a drain means is provided so as to drain the washing water collected in the drain portion 60*a* to the outside of the washing machine 1. The drain means may include connection pipes 63, 64 and 65 connecting the drain pump 26 and the drain portion 60*a* to each other and a compulsory drain means 80 or a check valve 70 installed at the connection pipes 63, 64 and 65.

With such configuration, it is capable of collecting washing water or moisture remaining at the gasket 60 after completing a washing course of the drum type washing machine 1 and then draining the washing water or moisture, thereby being capable of reducing odor generated at the gasket 60. And, a blower 90 may be provided at an uppermost end portion of the gasket 60.

Figure 4:
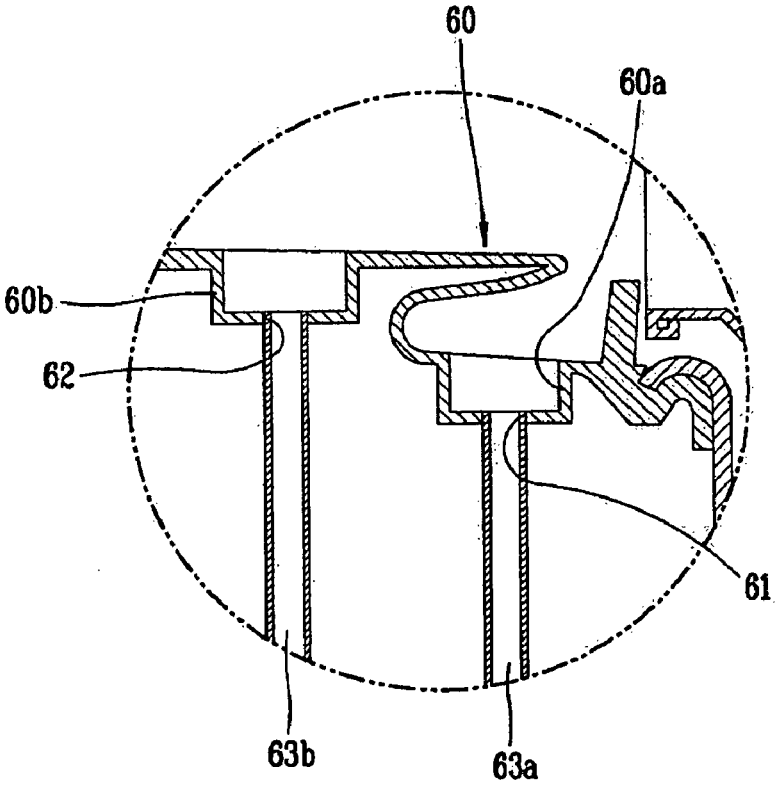
FIG. 4 is an enlarged section view showing "A" portion in FIG. 2.

As shown in FIG. 4, at least one drain portion 60*a* or 60*b* is formed to be concave at a lower end portion of the gasket 60. The gasket 60 has the folded middle portion to overlap each other. The drain portion can be formed at least one of the relatively upper or lower portion in the overlapping portion. FIG. 3 shows the gasket 60 provided with two drain portions 60*a*, 60*b*.

As the drain portions 60*a*, 60*b* are concavely formed, it is capable of enhancing a collection efficiency on washing water. In addition, as the drain portions 60*a*, 60*b* have edge portions formed to be inclined, it may be capable of more enhancing the collection efficiency on washing water.

And, drain holes 61, 62 may be further formed at the drain portions 60*a*, 60*b*. In case that only drain portions 60*a*, 60*b* are formed, the washing water collected in the drain portions 60*a*, 60*b* can be removed only in an air dry or evaporative manner. Meanwhile, in case of further forming the drain holes 61, 62 at the drain portions 60*a*, 60*b*, since washing water collected in the drain portions 60*a*, 60*b* can be smoothly drained through the drain holes 61, 62, it is capable of enhancing a removal efficiency on the washing water.

Here, the drain holes 61, 62 of the drain portions 60*a*, 60*b* are respectively connected to first connection pipes 63*a*, 63*b* among the connection pipes 63, 64, 65. The first connection pipes 63*a*, 63*b* may be connected to the drain hose 27 after being combined with each other or in a respectively diverging status.

So far, explained was a method for naturally draining washing water remaining at the gasket 60 by forming the drain portions 60*a*, 60*b*, the drain holes 61, 62, the first connection pipe 63, the check valve 70 and the second connection pipe 64. However, in order to enhance the drainage efficiency, a compulsory drain means may be further provided.

Here, the compulsory drain means may be implemented as the drain pump 26 installed at the lower portion of the cabinet 60 so as to outwardly drain washing water from the tub 20. The drain pump 26 is connected to the drain hole 61 formed at the drain portion 60*a*, preferably. That is, there is no need to additionally install the compulsory drain means. The pre-installed drain pump 26 can be used to drain washing water collected in the drain portion 60*a*.

And, referring to FIG. 2, the check valve 70 may be further installed at the first connection pipe 63. In case that the drain pump 26 is operated to drain polluted washing water from the tub 20 after completing a general washing course, by closing the first connection pipe 63 using the check valve 70, it is capable of preventing the washing water collected in the drain portions 60*a*, 60*b* from being introduced into the drain pump 26.

If the washing water remaining at the gasket 60 is introduced into the drain pump 26 through the first connection pipe 63*a* even when the drain pump 26 is operated to drain polluted washing water from the tub 20 after completing the washing course, a normal drainage efficiency may be deteriorated.

In case that the check valve 70 is provided, it is advantageous that the check valve 70 is connected to the drain holes 61, 62 by the first connection pipe 63 and is also connected to the drain pump 26 by the second connection pipe 64 so as to form a flow path.

Meanwhile, the compulsory drain means may be implemented as an additional device instead of the drain pump 26. That is, as shown in FIG. 2, a suction fan 80 installed between the drain pump 26 and the drain portion 60*a* and serving to suck washing water or residual water collected in the drain portion 60*a* may be used as the compulsory drain means.

As such, by additionally installing the suction fan 80 as the compulsory means in addition to the drain pump 26, it is capable of draining washing water that is not naturally drained. Here, the suction fan 80 is installed at the second connection pipe 64, preferably. That is, the suction fan 80 is installed between the check valve 70 and the drain pump 26. In this case, the check valve 70 is connected to the suction fan 80 by the second connection pipe 64 and the suction fan 80 is connected to the drain pump 26 by the third connection pipe 65.

Here, the check valve 70 may be installed between the drain portion 60*a* and the suction fan 80 and also be installed between the suction fan 80 and the drain pump 26. That is, if only the check valve 70 is installed in front of the drain pump 26, it can be installed at either a front side of the suction fan 80 or a rear side thereof.

Meanwhile, the third connection pipe 65 connected to an outlet of the suction fan 80 may be directly connected to the drain hose 27 without connecting to the drain pump 26. That is, it may be configured to drain residual washing water from the suction fan 80 directly through the drain hose 27 without passing through the drain pump 26. In such configuration, residual washing water collected in the drain portion 60*a* of the gasket 60 is not introduced into the drain pump 26, accordingly it is not required to install the check valve 70.

Figure 5:
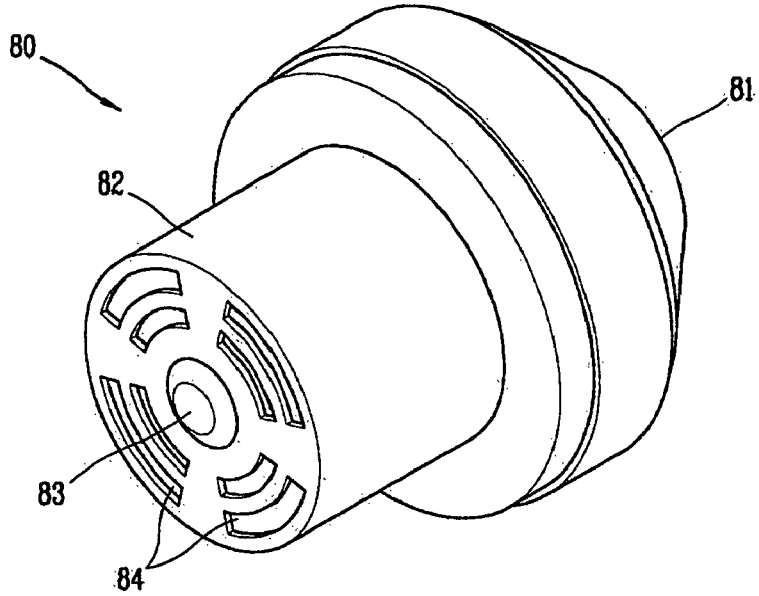
FIG. 5 is a perspective view showing a suction fan of FIG. 2.

FIG. 5 is a perspective view showing a suction fan in FIG. 2. The suction fan 80 includes a suction opening 81 through which washing water is introduced, a motor 82 for driving a fan (not shown) and drain openings 84 through which the sucked washing water can be drained. Unexplained reference numeral "83" denotes a rotary shaft of the fan. Here, the suction fan 80 is implemented as a fan motor in which the fan and the motor 82 are integrally formed. And, it is effective that the suction fan 80 is waterproofed. Since the washing water collected in the drain portion 60*a* of the gasket 60 flows in the suction fan 80, if the suction fan 80 is not waterproofed, there may be a possibility of a short-circuit.

And, preferably, the suction fan 80 is implemented as an axial fan because it is advantageous to form the flow path through which washing water flows. That is, since the flow path is formed in back and forth directions of the axial fan, it is capable of simplifying a structure of the flow path.

Figure 6:
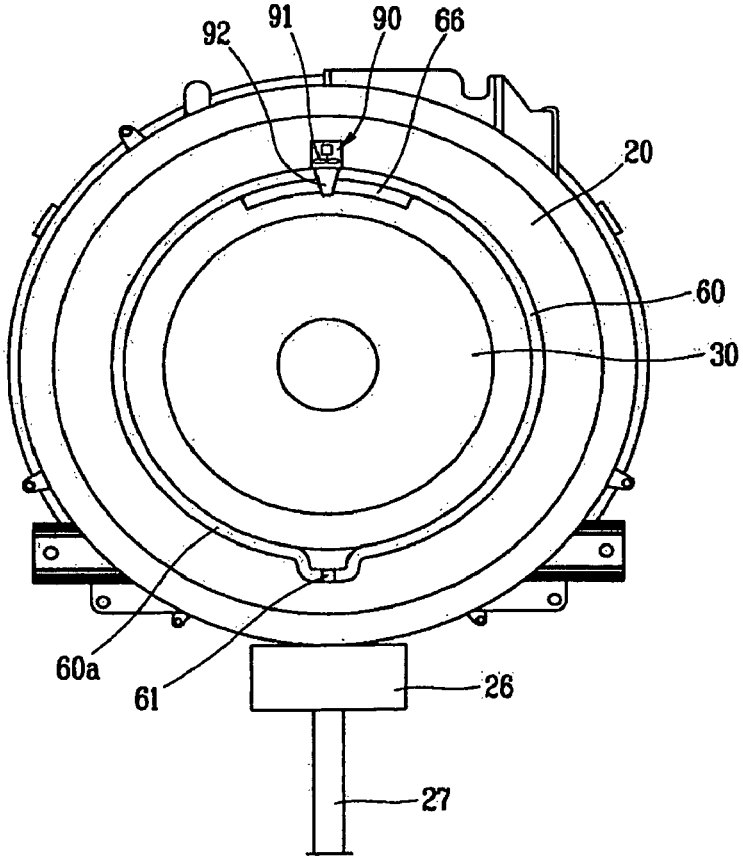
FIG. 6 is a section view showing a state that a blower is mounted at a gasket in FIG. 2.

Meanwhile, an additional configuration for inducing washing water or residual water remaining on a surface of the gasket 60 to be introduced into the drain portion 60*a* may be further provided. It will be explained with reference to FIG. 6. FIG. 6 is a section view showing a state that a blower is mounted at a gasket of the drum type washing machine of FIG. 2.

As shown in FIG. 6, the blower 90 by which air blows along the gasket 60 may be additionally provided at one side of an upper portion of the gasket 60. Accordingly, the washing water not having flown toward the drain portion 60*a* formed at the lower portion of the gasket 60 can be introduced to the drain portion 60*a*.

Preferably, the blower 90 includes a nozzle 92 penetratingly mounted at the gasket 60 and a blower fan 91 generating air ejected through the nozzle 92. Here, the gasket 60 at which an outlet end of the nozzle 92 of the blower 90 is mounted may be provided with at least one blower guide portion 66 for inducing air blown by the blower 90 to blow along the surface of the gasket 60.

If there is no the blower guide portion 66, the air from the blower 90 may be introduced into the drum 20 without blowing along the surface of the gasket 60.

And, preferably, the blower 90 is operated in a state that the door 40 of the washing machine 1 is closed. If the blower 90 is operated in a state that the door 40 is open, washing water remaining at the gasket 60 may be naturally dried while air blows in and out.

Meanwhile, the blower 90 is disposed to face the drain portion 60*a* so as to increase the amount of air blowing on the entire surface of the gasket 60.

The drain portion 60*a* may be coated with an antibiotic material such as lactic-acid of fermented kimchi, accordingly it is capable of preventing the gasket 60 from being polluted by foreign materials such as mold.

The lactic-acid of fermented kimchi is produced through a fermentation process of kimchi, a Korean traditional food. The fermentation process of kimchi is as follows. First, radishes, cabbages and cucumbers are salted down. And, the salted radishes, cabbages and cucumbers are ripened as lactic-acid is generated. Alternately, after the salted things are spiced with red pepper, garlic, leeks, ginger and salted fish, they are ripened as lactic-acid is generated. And then, they are fermented at low temperature. The lactic-acid of fermented kimchi is known as a natural antibiotic material characterized that it is safe as people have eaten it for a long time, it is easily obtained and economical, and it has a great antibiotic susceptibility and a broad antibiotic spectrum.

The aforementioned compulsory drain means 26, 80, the blower 90 or the check valve 70 may be automatically operated after completing the washing course of the washing machine or be manually operated by a user's selection. That is, supposing that a button for a gasket drying function or an odor removing function is provided in a control panel (not shown), the user can operate the compulsory drain means 26, 80, the blower 90 or the check valve 70 by pressing the button.

Meanwhile, in accordance with another exemplary embodiment of the present invention, a heating member may be installed in a gasket or at a periphery of the gasket so as to remove moisture remaining at the gasket, which will be explained with reference to FIGS. 7 to 11. The another embodiment will be explained with separate reference numerals for explanatory convenience.

Figure 7:
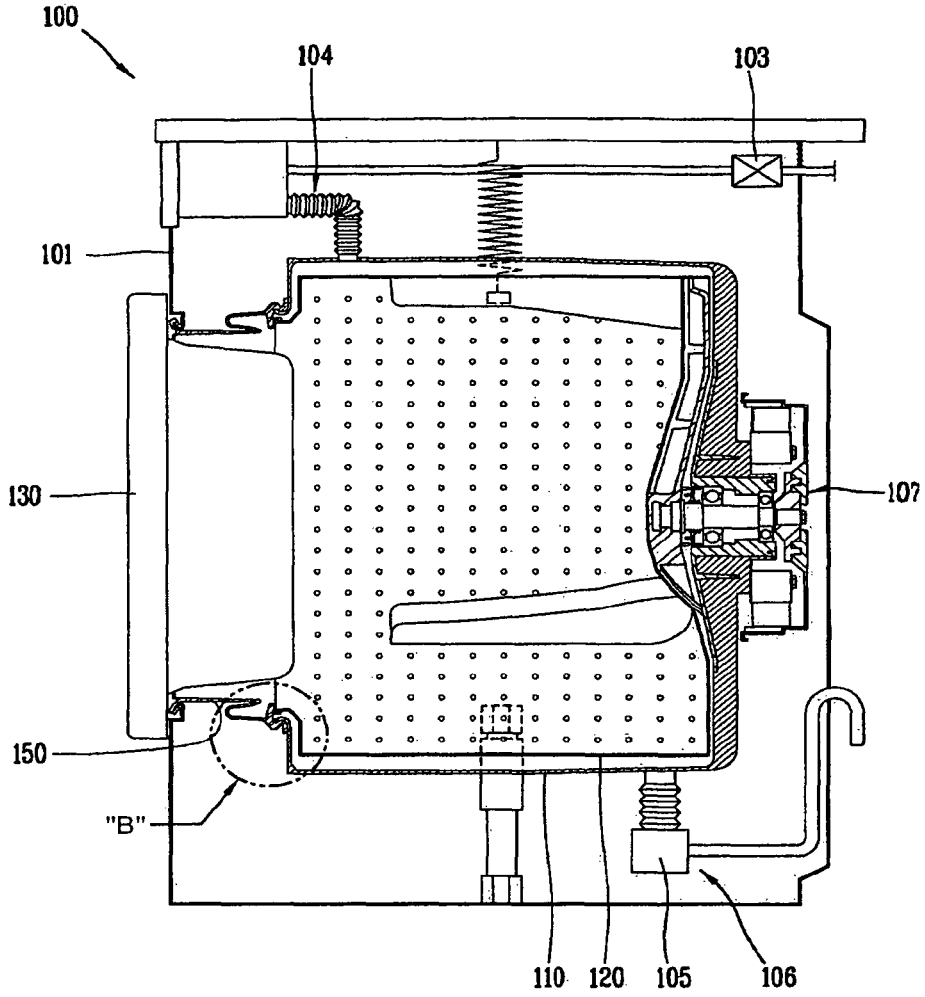
FIG. 7 is a section view showing a drum type washing machine in accordance, with another exemplary embodiment of the present invention.

Referring to FIG. 7, a drum type washing machine 100 in accordance with the another embodiment of the present invention includes a cabinet 101 having an opening 102 through which laundry is introduced into, a door 130 by which the opening 102 is opened/closed, a tub 110 installed to be attenuatable in the cabinet 101 so as to contain washing water, a water supply device 104 including a water supply valve 103 so as to supply washing water to the tub 110, a drain device 106 including a drain pump 105 for draining polluted washing water in the tub 110, a drum 120 rotatably installed in the tub 120 so as to contain laundry, a motor 107 installed at the tub 110 so as to rotate the drum 120 and a door switch 131 by which the door 130 is locked/unlocked. And, a gasket 150 is installed along a peripheral portion of the opening 102 so as to seal a gap between the opening 102 and the tub 110.

Figure 8:
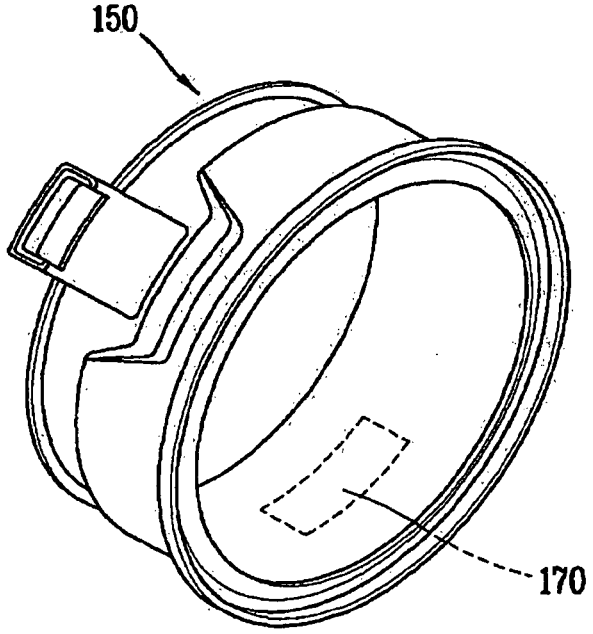
FIG. 8 is a perspective view showing a gasket of FIG. 7.

Here, as shown in FIG. 8, the gasket 150 is formed in a ring or loop shape having a specific height. And, the gasket 150 has a folded middle portion overlapping each other. The gasket 150 encompassing the door 130 is folded to be overlapped with each other.

Figure 9:
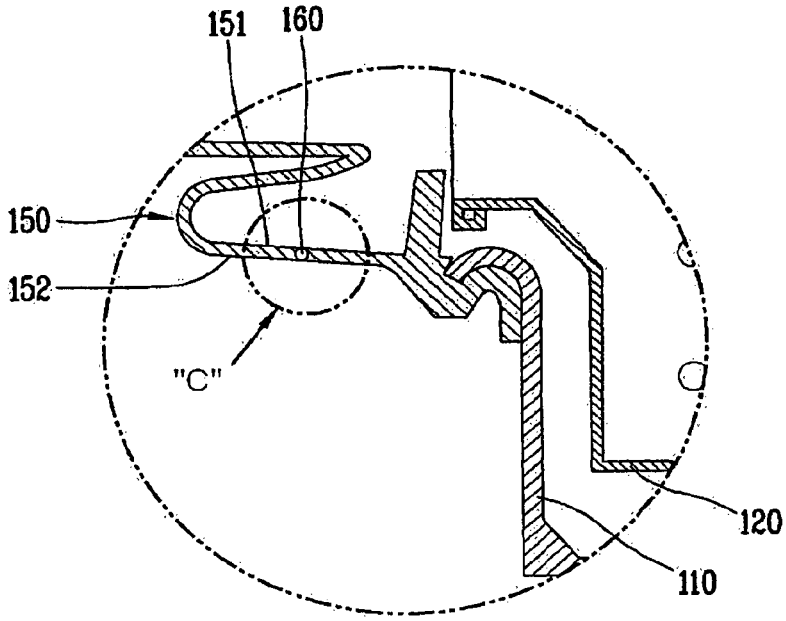
FIG. 9 is an enlarged section view showing "B" portion in FIG. 7, which shows a gasket and a heating member according to one aspect of the present invention.
Figure 10:
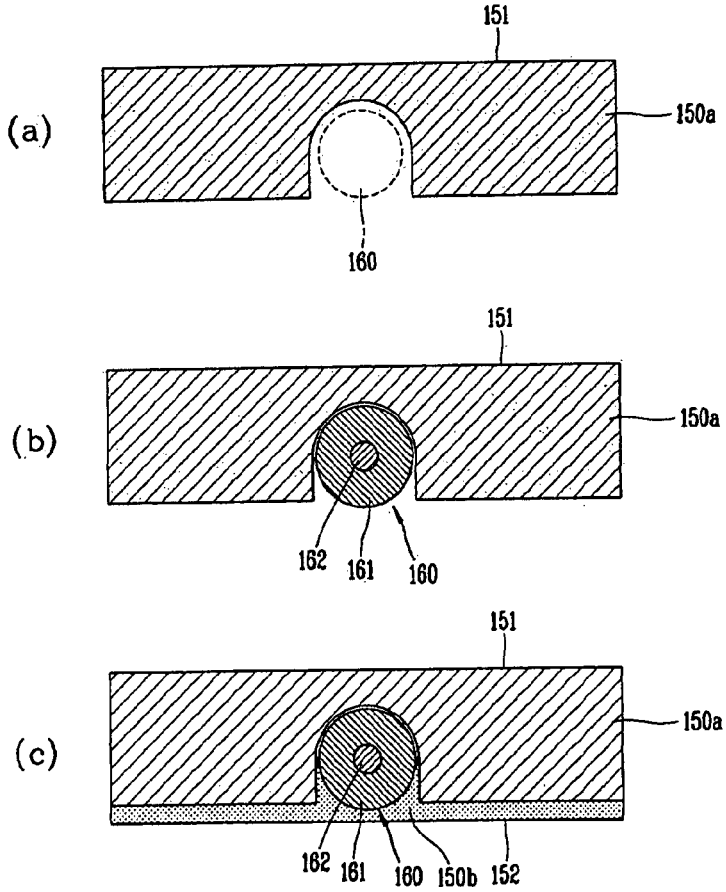
FIG. 10 is an enlarged section view showing "C" portion in FIG. 9, which shows a process for mounting the heating member.

FIG. 9 is an enlarged section view showing "B" portion in FIG. 7, which shows a gasket and a heating member according to one aspect of the present invention, and FIG. 10 is an enlarged section view showing "C" portion in FIG. 9, which shows a process for mounting the heating member.

As shown in FIG. 9, a heating member 160 is formed so as to remove moisture existing at a middle portion of a lower end of an inner side surface 151 of the gasket 150. Heating the middle portion of the lower end of the inner side surface 151 of the gasket 150 using the heating member 160, the moisture existing at the middle portion of the lower end of the inner side surface of the gasket 150 can be evaporated.

Here, the heating member 160 may be mounted in a lower end portion of the gasket 150, accordingly it is capable of increasing the amount of heat conducted to the surface of the gasket 150 from the heating member 160.

The gasket 150 is formed of a rubber material in an injection molding manner. Thus, it is effective that the heating member 160 is also mounted in the gasket 150 in the injection molding manner.

FIG. 10 sequentially shows a process that the gasket 150 is molded in the injection manner with mounting the heating member 160 therein. As shown in FIG. 10, the gasket 150 is composed of an upper injection molded body 150*a* and a lower injection molded body 150*b*. Here, the upper injection molded body 150*a* of the gasket 150 is provided with a heating member receiving portion for receiving the heating member 160. When molding the upper injection molded body 150*a* of the gasket 150 in the injection manner, a mold (not shown) is configured to have a structure for forming the heating member receiving portion.

First, after molding the upper injection molded body 150*a* in the injection manner (a in FIG. 10), the heating member 160 is received in the heating member receiving portion (b in FIG. 10) and then the lower injection molded body 150*b* is molded in the injection manner (c in FIG. 10), accordingly it is capable of obtaining the gasket 150 in which the heating member 160 is mounted. Here, it is effective that a gap is generated between the heating member 160 and the heating member receiving portion resulting from forming the heating member receiving portion to be larger than the heating member 160. When the gap between the heating member 160 and the heating member receiving portion is filled with the lower injection molded body 150*b*, the heating member 160 is firmly mounted in the upper injection molded body 150*a* and the lower injection molded body 150*b*. An unexplained reference numeral 151 denotes an inner side surface of the gasket and another unexplained reference numeral 152 denotes an outer side surface of the gasket.

Meanwhile, the heating member 160 has a circular shaped section. And the heating member 160 is composed of a heating body 162 formed by a resistive substance so as to emit heat and an insulation body 161 encompassing the heating body 162. Here, a power supply line (not shown) is connected to the heating body 162 so as to supply power. And, since the gasket 150, is formed of the rubber material, the heating body 162 can be mounted in the gasket 150 without the additional insulation body 161.

And, in case that it is difficult to mount the insulation body 161 in the gasket 150 because the gasket 150 is thin, only the heating body 162 can be mounted in the gasket 150 without the insulation body 161. In this case, the heating member receiving portion may be smaller according to a size of the heating body 162. Here, the heating member 160 or the heating body 162 may be implemented as a heater or heat lines, preferably.

Meanwhile, the heating member can be installed another position, which will be explained with reference to a drawing.

Figure 11:
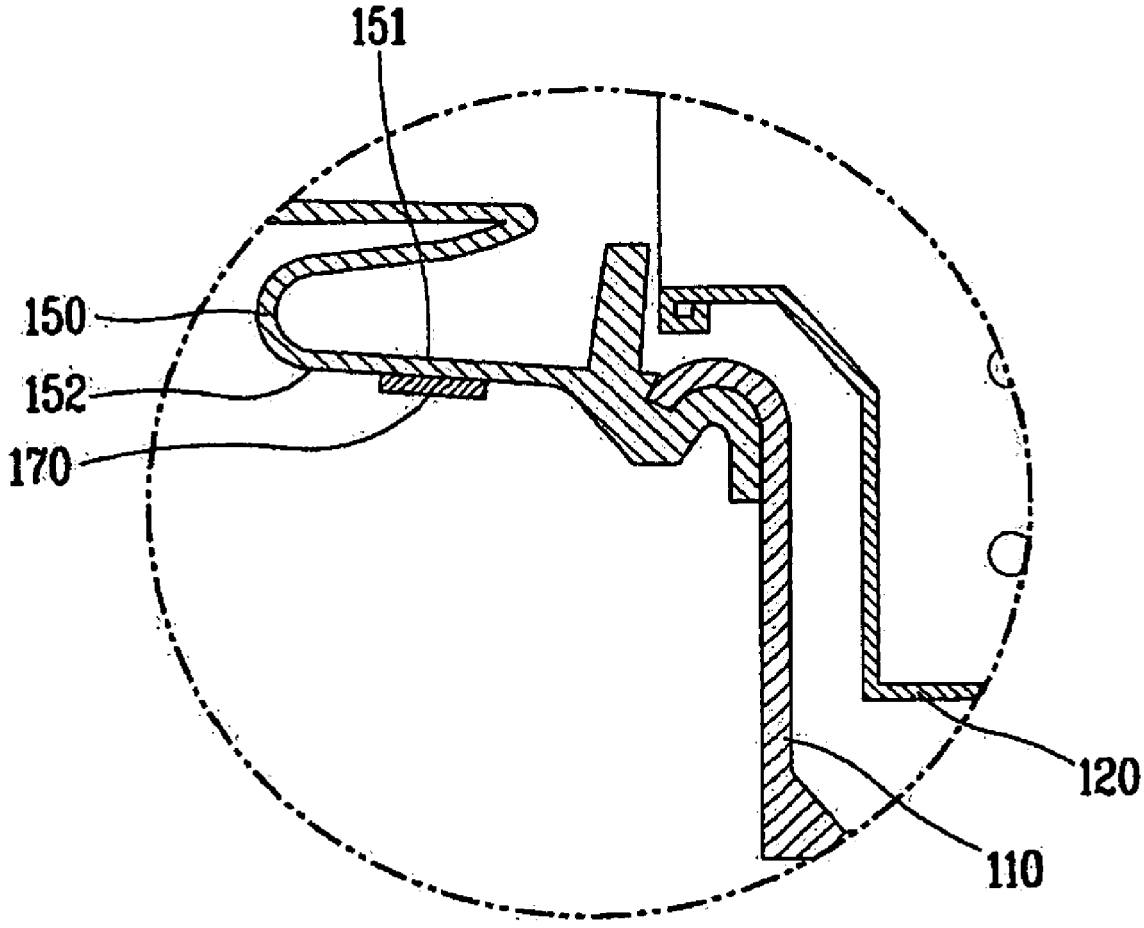
FIG. 11 is an enlarged section view showing "B" portion in FIG. 7, which shows a gasket and a heating member according to another aspect of the present invention.

FIG. 11 is an enlarged section view showing "B" portion in FIG. 7, which shows a gasket and a heating member according to another aspect of the present invention. As shown in FIG. 11, a heating member 170 may be attached onto the outer side surface 152 of the lower end portion of the gasket 150, or be installed at the lower portion of the gasket 150 with being spaced from the lower end portion of the inner side surface 151 of the gasket 150.

In case that it is difficult to mount the heating member 170 in the gasket 150 because the gasket 150, is thin, the heating member 170 may be installed at the lower portion of the gasket 150 with being spaced from the lower end portion of the gasket 150 or be attached onto the outer side surface 152 of the lower end portion of the gasket 150.

Here, in case that the heating member 170 is attached onto the inner side surface 151 or outer side surface 152 of the lower end portion of the gasket 150, it is effective that the heating member 170 is implemented as adhesive sticker type heat lines. That is, as shown in FIG. 8, the heating member 170 implemented as the adhesive sticker type heat lines having a specific area and formed to be thin may be attached onto the inner side surface 151 or the outer side surface 152 of the gasket 150.

Here, in case that the heating member 170 implemented as the adhesive sticker type heat lines is installed at the inner side surface 151 of the lower end portion of the gasket 150, it is effective that the heating member 170 is waterproofed. Because most of the washing water or moisture is collected at the inner side surface 151 of the lower end portion of the gasket 150, the heating member 170 had better be waterproofed so as to prevent the user from being in danger caused by a short circuit.

Meanwhile, preferably, the heating members 160, 170 implemented as the heater or heat lines are formed in a strip type that is curved several times so as to maximize a heating value thereof. By mounting the heat lines curved in a zigzag format in the gasket 150 or disposing the adhesive sticker type heat lines in the zigzag format, more heat lines can be mounted in the gasket 150 or on the surface thereof.

Here, preferably, a maximum heating temperature of the heating members 160, 170 does not exceed 150° C. by adjusting a resistance value of a heating body of each heating member 160, 170. If the maximum heating temperature exceeds 150° C., the gasket may be melted.

And, preferably, each heating member 160, 170 is configured to heat a portion corresponding to ⅓ to ½ of the entire length of the gasket 150. That is, each heating member 160, 170 has only to be configured to heat the portion corresponding to ⅓ to ½ of the entire circumstance of the gasket 150 on the basis of a lowermost end portion of the gasket 150. Since the washing water or moisture is mainly collected at the peripheral portion of the gasket 150 including the lowermost end portion thereof, the heating member has only to be installed at the corresponding portion.

Meanwhile, it is effective that each heating member 160, 170 is operated in a state that the door 130 is closed. Air may be introduced into the drum 120 when the door 130 is open, thus washing water or moisture existing at the gasket 150 may be naturally dried/evaporated. In this case, it is not required to operate each heating member 160, 170.

Also, each heating member 160, 170 is operated automatically or manually during the washing course. That is, it is configured to supply power to each heating member 160, 170 only when the user selects or every last step of the washing course. Here, a time for supplying the power to each heating member 160, 170 may be pre-set, accordingly it is capable of preventing each heating member 160, 170 from being overheated.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present inventive features may be embodied in several forms, without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A drum type washing machine comprising:

a cabinet having an opening through which laundry is introduced into;

a door installed at the cabinet, by which the opening is opened/closed;

a tub installed in the cabinet;

a drum rotatably installed in the tub;

a gasket installed between the opening of the cabinet and the tub so as to seal a gap between the door and the tub;

a moisture removing means provided at a lower end of an inner side surface of the gasket, wherein the moisture removing means comprises:

a drain portion concavely formed at a lower end portion of the gasket;

a drain hole provided at the drain portion; and a compulsory drain means for removing moisture collected in the drain portion, wherein the compulsory drain means comprises:

a drain pump installed at a lower portion of the cabinet so as to outwardly drain washing water, the drain pump connected to the drain hole by connection pipes; and a suction fan installed between the drain pump and the drain portion and configured to suck moisture collected in the drain portion.

2. The washing machine of claim 1, further comprising a blower by which air blows is provided at an upper portion of the gasket so as to induce moisture existing on a surface of the gasket to be introduced into the drain portion, wherein the blower comprises a nozzle penetratingly mounted at the gasket, a blower fan generating air ejected through the nozzle, and a blower guide portion formed at the gasket connected to an outlet end of the nozzle so that air blown by the nozzle can blow along the surface of the gasket.

3. The washing machine of claim 1, wherein the drain portion is coated with an antibiotic material.

4. The washing machine of claim 1, wherein a check valve is installed at the connection pipes.

5. The washing machine of claim 1, wherein the suction fan is implemented as an axial fan.

* * * * *